US010258178B2

(12) United States Patent
Gervasi

(10) Patent No.: US 10,258,178 B2
(45) Date of Patent: Apr. 16, 2019

(54) TAPERED CHOPSTICK WITH END-BIASED BALANCE POINT

(71) Applicant: Vito Russel Gervasi, Pewaukee, WI (US)

(72) Inventor: Vito Russel Gervasi, Pewaukee, WI (US)

(73) Assignee: Vito Russel Gervasi, Pewaukee, WI (US)

( * ) Notice: Subject to any disclaimer, the term of this patent is extended or adjusted under 35 U.S.C. 154(b) by 0 days.

(21) Appl. No.: 15/908,106

(22) Filed: Feb. 28, 2018

(65) Prior Publication Data

US 2018/0249851 A1 Sep. 6, 2018

Related U.S. Application Data

(60) Provisional application No. 62/465,777, filed on Mar. 1, 2017.

(51) Int. Cl.
*A47G 21/10* (2006.01)
*A47G 21/06* (2006.01)

(52) U.S. Cl.
CPC ..... *A47G 21/103* (2013.01)

(58) Field of Classification Search
CPC ..... A47G 21/103; A47G 21/02; A47G 21/04; A47J 43/28; A47J 43/283; A47J 43/281
USPC ..... 294/218; 30/322, 324
See application file for complete search history.

(56) References Cited

U.S. PATENT DOCUMENTS 3,889,995 A * 6/1975 Lin ..... A47G 21/103 294/33
5,277,464 A * 1/1994 Okun ..... A47G 21/103 294/218
D433,883 S * 11/2000 Wei ..... D7/642
6,607,225 B1 * 8/2003 Lai ..... A47G 21/103 294/218
7,341,293 B2 * 3/2008 Tsai ..... A47G 21/103 294/218
7,896,413 B2 * 3/2011 Shen Ku ..... A47G 21/103 294/218
9,259,111 B1 * 2/2016 Joyner ..... A47G 21/103
2005/0217495 A1 * 10/2005 Smith ..... A22C 17/006 99/419
2009/0121501 A1 * 5/2009 Liu ..... A47G 21/10 294/218
2010/0078952 A1 * 4/2010 Hurson ..... A47G 21/10 294/99.2
2012/0263918 A1 * 10/2012 Cuillery ..... A47J 43/288 428/156

FOREIGN PATENT DOCUMENTS

GB 2 089 198 * 6/1982

* cited by examiner

*Primary Examiner* — Dean J Kramer
(74) *Attorney, Agent, or Firm* — Boyle Fredrickson, S.C.

(57) ABSTRACT

A pair of chopsticks in which each chopstick provides an extenuate body tapering to a tip with an internal weighting moving the center of gravity of the chopstick toward the tip with respect to the midpoint of the chopstick to provide improved operability and to permit the chopstick to rest on small dishes with the tip in a downward orientation when an edge of the dish supports the chopstick toward its tip with respect to the midpoint.

13 Claims, 1 Drawing Sheet

TAPERED CHOPSTICK WITH END-BIASED BALANCE POINT

CROSS REFERENCE TO RELATED APPLICATION

This application claims the benefit of U.S. provisional application 62/465,777 filed on Mar. 1, 2017, and hereby incorporated by reference in its entirety.

BACKGROUND OF THE INVENTION

The present invention relates to chopsticks and in particular to chopsticks having a balance point biased toward the tip of the chopstick and away from the visual center of mass.

Chopsticks were invented in ancient China and are now used in most of East Asia. They consist of a pair of pencil-sized sticks from 7 to 16 inches in length that may be held in one hand in pincer style to pick up pieces of food. Many chopsticks, particularly disposable ones, are manufactured from wood but a variety of other materials are also used including stainless steel and plastic.

For aesthetic reasons and for improved ergonomics, many chopsticks are tapered from a "handle" end to a smaller tip.

SUMMARY OF THE INVENTION

The present invention provides chopsticks having a center of gravity moved toward a tip in strong contrast to a typical tapered chopstick which is weighted toward the handle. This is accomplished, within the desired tapered form factor, by means of a lightweight handle and weighted tip. By moving the weight toward the tip, improved control can be had particularly by those familiar with tip-weighted utensil such as forks and spoons. In addition, the chopsticks can be rested on small dishes such as soy sauce dishes with the tip down preventing liquid from running toward the handle onto the table.

Specifically, at least one embodiment of the invention provides chopsticks each having an extenuate body with a handle end opposite a tip end, the body tapering inward from the handle end to the tip end wherein a center of gravity of the body is positioned toward the tip end between the tip end and a point halfway between the handle end and the tip end.

It is thus a feature of at least one embodiment of the invention to provide a chopstick having a tip-forward weighting defying the normal center of gravity of such chopsticks to provide improved stability, usability and integration with dishes on which they may be rested.

The handle end may provide an outer shell of a first material surrounding a lightweight core of lower density than the first material.

It is thus a feature of at least one embodiment of the invention to promote a tip-forward weighting by substantially reducing the weight of the handle end by employing a lightweight core.

The lightweight core may be selected from air, polymer foam, or balsa.

It is thus a feature of at least one embodiment of the invention to provide extremely lightweight cores that maximize movement of the center of gravity toward the tip.

The first material may be a fiber composite material.

It is thus a feature of at least one embodiment of the invention to compensate for a lightweight core in terms of reduced strength by maximizing the tensile strength of the outer shell of the handle.

The first material may be carbon fiber.

It is thus a feature of at least one embodiment of the invention to provide a composite material of great strength and improved aesthetic quality.

The fiber composite may be a fabric having a warp and a woof of crossing fibers.

It is thus a feature of at least one embodiment of the invention to provide a simple method of distributing the fibers around the dimensions of the handle with axially aligned fibers.

The warp and woof fibers may extend along bias lines tipped with respect to an axis between the first end and the second end along the length of the body.

It is thus a feature of at least one embodiment of the invention to make use of a fabric sleeve allowing ready conformance to a tapered surface.

The handle end may provide an outer rippled surface having a periodicity of greater than one-quarter inch.

It is thus a feature of at least one embodiment of the invention to improved gripping of the handles through the use of an undulating surface.

The tip may provide a metallic element extending from the tip end no further than to a point between the tip and a point halfway between the handle end and the tip end.

It is thus a feature of at least one embodiment of the invention to employ a metallic element to maximize forward weighting of the chopstick.

The metallic element may be exposed at the tip end and may be stainless steel.

It is thus a feature of at least one embodiment of the invention to provide a narrow tip of high density for forward weighting.

The metallic tip may have a radial micro finish of grooves extending circumferentially around the tip.

It is thus a feature of at least one embodiment of the invention to increase the tooth of the tip for better gripping of food items The metallic element may be embedded within a material of lower density forming the outer surface of the tip.

It is thus a feature of at least one embodiment of the invention to use an internal metal weight providing greater manufacturing flexibility with respect to food compatibility.

The material of lower density may be wood.

It is thus a feature of at least one embodiment of the invention to provide a chopstick conforming to an all wood aesthetic.

The chopstick may further include a ferule surrounding the body at a junction point between different materials of the head end and tip end.

It is thus a feature of at least one embodiment of the invention to provide a simple method of joining different materials to provide forward weighting of the chopstick.

These particular objects and advantages may apply to only some embodiments falling within the claims and thus do not define the scope of the invention.

DETAILED DESCRIPTION OF THE PREFERRED EMBODIMENT

Figure 1:
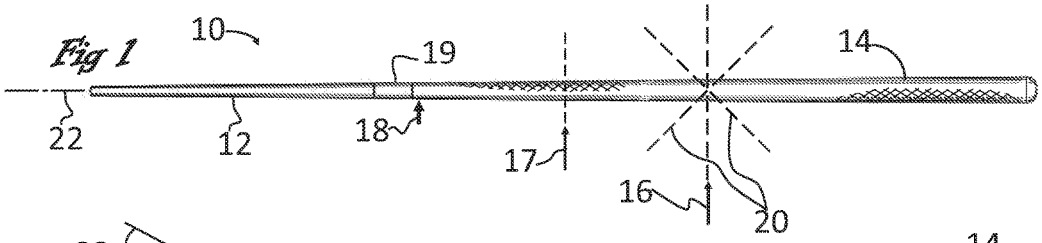
FIG. 1 is a side elevational view of one stick of a pair of chopsticks according to the present invention showing a gravitational balance point displaced with respect to a visual balance point.

Referring now to FIG. 1, a set of chopsticks according the present invention may include two identical chopsticks 10 each providing, at one end, a metallic tip 12, for example, constructed of stainless steel or tungsten carbide tapering substantially continuously to increasing diameters toward and joining a carbon fiber handle 14 at the other end of the chopstick 10. The total length of the chopstick along axis 22 may be approximately 7 to 12 inches.

Figure 3:
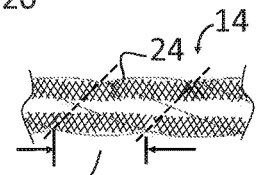
FIG. 3 is a fragmentary, side elevational view of one chopstick showing the undulating spiral grip formed by biased-wrapped carbon fiber.

The tip 12 may have a smallest diameter of 0.1 inches and the handle 14 may have a largest diameter of 0.35 inches. In one embodiment, the carbon fiber handle 14 is substantially black constructed of a woven mat of black carbon fibers within a transparent epoxy resin matrix to provide a water impermeable outer surface. The warp and woof of the carbon fibers may lie along biased lines 20 angled at approximately 45 degrees with respect to the axis 22 to wind helically around the longest dimension of the chopstick 10. Referring momentarily to FIG. 3, this bias wrapping of carbon fibers may provide a slight undulation 24 to the outer surface of the handle 14 following generally a helical spiral along the axis 22 resulting from interaction between the woven carbon fibers and a tapered form defining a mandrel about which the carbon fiber handle 14 is formed. These undulations may have periodicity 25 of greater than one-quarter inch. It will be appreciated that other fibers including glass and polymer fibers may be alternatively used such materials which may be colored and or metallized.

The carbon fiber handle 14 may join with the tip 12 at a seam covered by a ferrule 19, for example, the latter constructed of a thin-walled, stainless steel tube.

Figure 2:
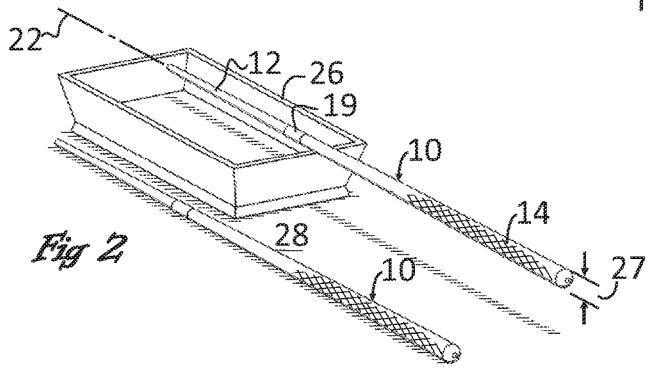
FIG. 2 is a perspective view of the chopsticks balanced in a small dish, for example, for holding soy sauce.

The chopstick 10 may have a visual balance point 16 such as would provide an actual gravitational balance point if the chopstick 10 were constructed of a uniform material of constant density. Typically, this visual balance point 16 will be displaced toward the handle 14 beyond a halfway point 17 midway along the length of the chopstick 10. As will be discussed below, however, this construction of the chopstick 10 is such as to bias the actual gravitational balance point 18 toward the tip 12, approximately one third of the length of the chopstick 10 from the end of the tip 12 and displaced toward the tip 12 past the midpoint 17 from the handle and 14. Referring also to FIG. 2, this actual gravitational balance point 18 allows the chopstick 10 to rest on the lip of the standard soy sauce dish 26 having dimensions of two inches by four inches in width and depth without the carbon fiber handle contacting the table 28 but instead being slightly elevated above the table by elevation distance 27 providing a general sloping of the axis 22 into the dish to prevent liquid from being conducted outward to the table.

Figure 4:
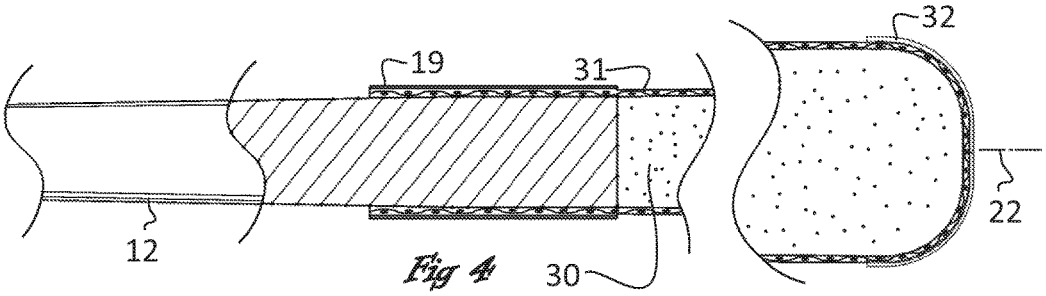
FIG. 4 is a fragmentary cross-section showing the hollow handle of the chopsticks as joined to a metal chopstick tip.

Referring now to FIG. 4, the handle 14 may be tubular and hollow providing an internal core 30 such as serves to move the gravitational balance point 18 forward. This core may be air (for example, provided by a removable core material or a meltable material that may be destructively removed) or light-weight polymer foam. Despite the lack of material in the core 30, suitable stiffness for control of the chopstick is obtained by the high stiffness obtained with the carbon fiber epoxy matrix forming an outer peripheral shell 31 providing a tube coaxially positioned about axis 22.

The epoxy matrix around the carbon fiber may serve to adhere the handle 14 to the tip 12 at a point of overlap under the ferrule 19. A decorative end cap 32 may optionally be placed over the end of the handle 14, for example, constructed of a pressed or embossed metal cup element, for example, having a character printed or formed thereon.

Figure 5:
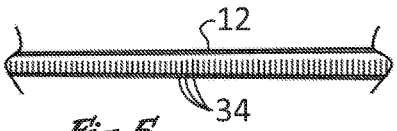
FIG. 5 is a fragmentary detail of the metal chopstick tip showing a radial micro finish.

Referring now to FIG. 5, the tip 12 may be finished with a circumferential polishing providing circumferentially directed grooves 34 to improve the grip or tooth provided by the tip 12. These grooves may be given a fine polish providing and iridescent sheen through a 0.001 grid abrasive.

Figure 6:
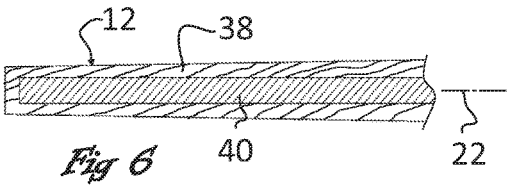
FIG. 6 is a cross-sectional view similar to FIG. 4 showing an internal metal weight.

Referring now to FIG. 6, when an "all wood" aesthetic is preferred the tip 12 may provide an outer wooden sheath 38 having a central metallic core 40, for example, formed of a high-density material such as tungsten.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a microprocessor" and "a processor" or "the microprocessor" and "the processor," can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

I claim:

1. A pair of chopsticks comprising:

a first and second stick each having an extenuate body having a handle end opposite a tip end, the body tapering inward from the handle end to the tip end wherein a center of gravity of the body is positioned toward the tip end between the tip end and a point halfway between the handle end and the tip end;

wherein the tip end provides a metallic element extending from the tip end no further than to a point between the tip end and a point halfway between the handle end and the tip end; and wherein the metallic element is embedded within a material of lower density forming an outer surface of the tip end.

2. The chopsticks of claim 1 wherein the handle end provides an outer shell of a first material surrounding a lightweight core of lower density than the first material.

3. The chopsticks of claim 2 wherein the lightweight core is selected from air and polymer foam.

4. The chopsticks of claim 2 wherein the first material is a fiber composite material.

5. The chopsticks of claim 4 wherein the first material is carbon fiber.

6. The chopsticks of claim 4 wherein the handle end provides an outer rippled surface having a periodicity of greater than one-quarter inch.

7. The chopsticks of claim 1 wherein the metallic element is exposed at the tip end and is a stainless steel.

8. The chopsticks of claim 7 wherein the tip end has a radial micro finish of grooves extending circumferentially around the metallic element providing iridescence.

9. The chopsticks of claim 1 wherein the material of lower density is wood.

10. The chopsticks of claim 1 further including a ferrule surrounding the body and a junction point between different materials of the handle end and tip end.

11. The chopsticks of claim 1 wherein the metallic material is a metal or tungsten carbide.

12. A pair of chopsticks comprising:

a first and second stick each having an extenuate body having a handle end opposite a tip end, the body tapering inward from the handle end to the tip end wherein a center of gravity of the body is positioned toward the tip end between the tip end and a point halfway between the handle end and the tip end;

wherein the handle end provides an outer shell of a first material surrounding a lightweight core of lower density than the first material;

wherein the first material is a fiber composite material; and wherein the fiber composite is a fabric having a warp and a woof of crossing fibers.

13. The chopsticks of claim 12 wherein the fibers of the warp and woof extend along bias lines tipped with respect to an axis between the handle end and the tip end along a length of the body.

* * * * *